US006561888B2

(12) United States Patent
Domanski et al.

(10) Patent No.: US 6,561,888 B2
(45) Date of Patent: May 13, 2003

(54) TOOL FOR SIZING AN O.D. SURFACE OF A CYLINDRICAL WORKPIECE

(75) Inventors: Stanley K. Domanski, Norridge, IL (US); Stephen C. Ball, Mt. Prospect, IL (US)

(73) Assignee: Accu-Cut Diamond Tool Company, Inc., Norridge, IL (US)

( * ) Notice: Subject to any disclaimer, the term of this patent is extended or adjusted under 35 U.S.C. 154(b) by 0 days.

(21) Appl. No.: 09/812,615

(22) Filed: Mar. 20, 2001

(65) Prior Publication Data

US 2002/0137449 A1 Sep. 26, 2002

(51) Int. Cl.[7] ..... B24D 11/00
(52) U.S. Cl. ..... 451/512; 451/526; 451/314
(58) Field of Search ..... 451/504–507, 451/51, 59, 495, 49, 449, 488, 496, 437, 440, 555, 180, 181, 464, 487; 269/99, 100, 261, 900, 314

(56) References Cited

U.S. PATENT DOCUMENTS

| | | | | | |
|---|---|---|---|---|---|
| 426,862 | A | | 4/1890 | Ross, Jr. | |
| 704,428 | A | * | 7/1902 | Allen | 451/180 |
| 1,717,554 | A | * | 6/1929 | Fraser | 451/180 |
| 2,326,711 | A | | 8/1943 | Weiland | |
| 2,472,554 | A | | 6/1949 | Volis | |
| 2,638,722 | A | | 5/1953 | Rimmel | |
| 2,702,446 | A | | 2/1955 | Johnson | |
| 2,774,200 | A | | 12/1956 | Block | |
| 3,166,876 | A | | 1/1965 | Manchester | |
| 3,188,674 | A | * | 6/1965 | Hobbs | 451/181 |
| 3,526,057 | A | | 9/1970 | Hackman, Jr. | |
| 4,188,755 | A | | 2/1980 | Fitzpatrick | |
| 4,223,485 | A | | 9/1980 | Largeteau | |
| 4,275,530 | A | | 6/1981 | Largeteau | |
| 4,458,453 | A | | 7/1984 | Helms et al. | |
| 5,022,196 | A | | 6/1991 | Schimweg et al. | |
| 5,056,265 | A | * | 10/1991 | Hurst | 451/180 |
| 5,185,970 | A | | 2/1993 | Fiocchi | |
| 5,371,978 | A | | 12/1994 | Higashikawa | |
| 5,482,498 | A | | 1/1996 | Higashikawa | |
| 5,529,529 | A | | 6/1996 | Judge et al. | |
| 5,564,792 | A | * | 10/1996 | Archibald | 301/5.21 |
| 5,672,096 | A | | 9/1997 | Amarosa et al. | |
| 5,707,279 | A | | 1/1998 | Mitchell et al. | |
| 5,961,382 | A | * | 10/1999 | Stoloski | 451/541 |
| 5,964,649 | A | * | 10/1999 | Bergqvist | 451/54 |
| 6,074,282 | A | * | 6/2000 | Schimweg | 451/49 |
| 6,139,414 | A | * | 10/2000 | Domanski et al. | 451/471 |

* cited by examiner

*Primary Examiner*—George Nguyen
(74) *Attorney, Agent, or Firm*—Orum & Roth

(57) ABSTRACT

A tool for sizing an O.D. surface of a cylindrical workpiece includes a rotatable substantially cylindrical member having an inner work-engaging surface adapted for finishing the O.D. surface of the cylindrical workpiece. The inner work-engaging surface includes abrasive particles thereon and defines a bore to receive the workpiece. The substantially cylindrical member includes at least one longitudinal split permitting radial expansion and contraction of at least part of the cylindrical portion for workpiece O.D. size adjustment.

17 Claims, 2 Drawing Sheets

TOOL FOR SIZING AN O.D. SURFACE OF A CYLINDRICAL WORKPIECE

BACKGROUND OF THE INVENTION

1. Field of the Invention

The present invention relates to a tool for sizing an O.D. surface of a cylindrical workpiece by means of a size-adjustable cylindrical bore having abrasive particles for sizing the workpiece.

2. Background Art

There is considerable prior art relating to the honing, deburring, lapping, finishing, and superfinishing of bores by means of various tooling structures. However, there is no known prior art which addresses problems associated with the accurate sizing of an outside diameter (O.D.) surface of a cylindrical workpiece for close tolerancing. For example, a pulley hub for a timing belt may require close tolerancing on its O.D. surface, and may require accurate concentricity of the O.D. surface with respect to the central axis of the hub. This close tolerancing may not be achieved with existing prior art turning or lathing operations.

Accordingly, there remains a need in the art for inexpensive machine tools for sizing O.D. surfaces of cylindrical workpieces in a manner in which precise size tolerancing can be achieved and concentricity with respect to a central axis of the workpiece can be achieved.

SUMMARY OF THE INVENTION

The present invention overcomes the above-referenced shortcomings of prior art O.D. surface sizing operations by providing a tool for sizing the O.D. surface of a cylindrical workpiece which includes an adjustable interior bore having abrasive particles thereon for accurately sizing the cylindrical workpiece.

As used herein, the term "sizing" is used to refer to finishing, superfinishing, lapping, deburring, polishing, or machining.

Preferably, the tool comprises a rotatable substantially cylindrical member (or "cylindrical portion") having an inner work-engaging surface adapted for finishing the O.D. surface of the cylindrical workpiece. The inner work-engaging surface includes abrasive particles thereon and defines a bore to receive the workpiece. The substantially cylindrical member includes at least one longitudinal split permitting radial expansion and contraction of at least part of the cylindrical portion for workpiece O.D. size adjustment.

An adjustment nut is threaded onto the substantially cylindrical member. The adjustment nut and substantially cylindrical member include at least one tapered adjustment surface therebetween which is operative as a cam to facilitate the expansion and contraction as the adjustment nut is rotated with respect to the substantially cylindrical member.

In one embodiment, the tapered adjustment surface is formed on an outside surface of the substantially cylindrical member. The adjustment nut includes at least one rubber preload ring engaged with the tapered adjustment surface to provide an adjustable compressive force on the substantially cylindrical member as the adjustment nut is rotated with respect to the substantially cylindrical member. This embodiment is particularly used for superfinishing the O.D. surface.

In another embodiment, the substantially cylindrical member comprises a tapered outer surface and the adjustment nut comprises a tapered portion slidably engageable with the tapered outer surface as the nut is rotated with respect to the substantially cylindrical member to provide an adjustable compressive force on the substantially cylindrical member as a result of interference-type engagement between the tapered portion of the nut and the tapered outer surface of the substantially cylindrical member. This structure is more rigid than the above-described embodiment, and is used primarily for rough-cutting, as opposed to superfinishing.

Accordingly, an object of the invention is to provide a tool for accurately sizing an O.D. surface of a cylindrical workpiece.

Another object of the invention is to provide a tool for accurately sizing an O.D. surface of a cylindrical workpiece which includes a cylindrical member defining a bore bordered by abrasive particles to receive and size the workpiece.

The above objects and other objects, features, and advantages of the present invention are readily apparent from the following detailed description of the best modes for carrying out the invention when taken in connection with the accompanying drawings.

DETAILED DESCRIPTION OF THE PREFERRED EMBODIMENT(S)

Figure 1:
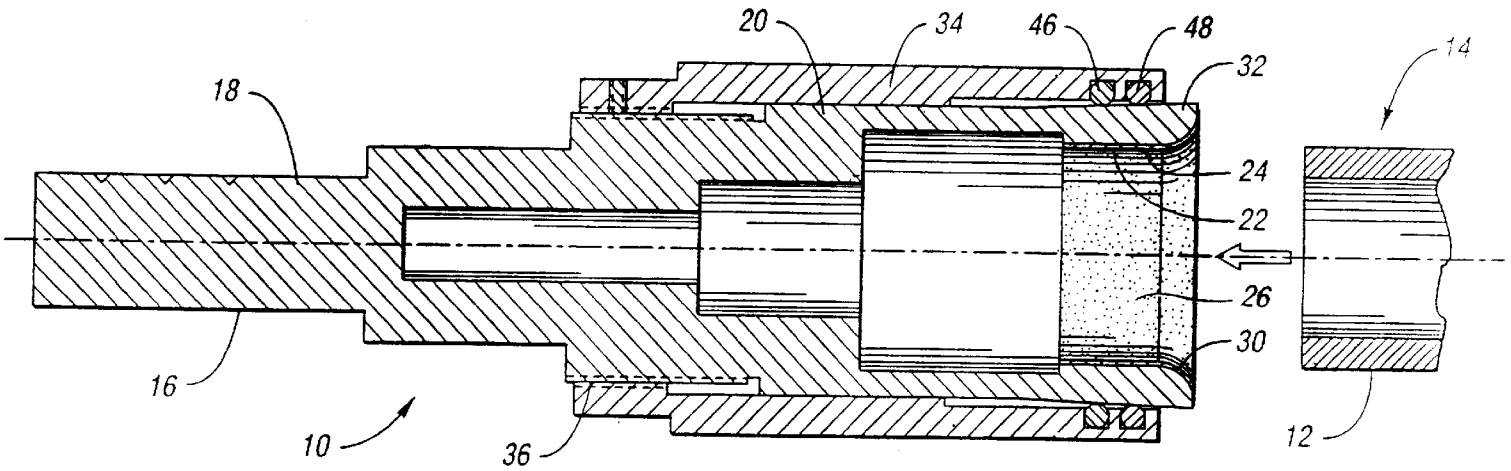
FIG. 1 shows a longitudinal cross-sectional view of a sizing tool and workpiece in accordance with a first embodiment of the invention.

Referring to FIGS. 1–5, an O.D. sizer tool 10 is shown in accordance with a first embodiment of the invention for sizing an outside diameter (O.D.) surface 12 of a cylindrical workpiece 14.

The sizer tool 10 comprises a body 16, which includes a shank portion 18, with a substantially cylindrical portion (or "member") 20 extending from the shank portion 18.

The substantially cylindrical portion 20 includes an inner work-engaging surface 22 with abrasive particles 24 thereon for finishing the O.D. surface 12 of the workpiece 14. Preferably, the abrasive particles 24 are diamond chips.

Figure 5:
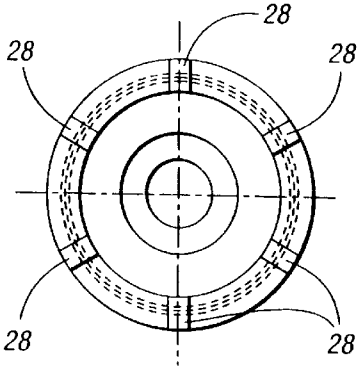
FIG. 5 shows an end view of the shank and substantially cylindrical portion shown in FIG. 4.
Figure 4:
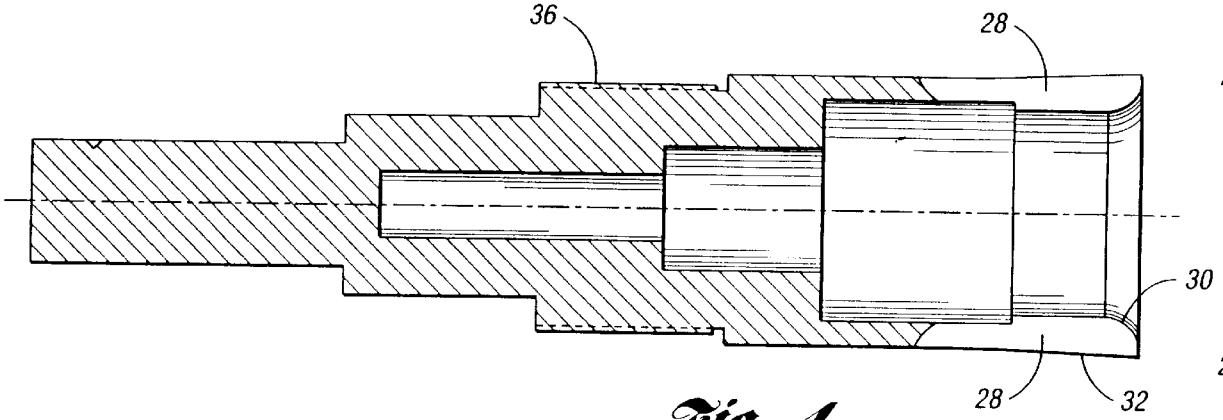
FIG. 4 shows a longitudinal cross-sectional view of a shank and substantially cylindrical portion of the tool of FIG. 1.

The inner work-engaging surface 22 defines a bore 26 to receive the workpiece 14, and includes a plurality of longitudinally extending splits 28, which are shown in FIGS. 4 and 5. The longitudinally extending splits 28 are configured to permit radial expansion and contraction of at least part of the cylindrical portion 20 for workpiece O.D. size adjustment.

The inner work-engaging surface 22 includes a curved lead-in edge 30 to facilitate insertion of the workpiece 14 into the bore 26.

In the embodiment shown in FIG. 1, the substantially cylindrical portion 20 includes a tapered outside surface 32 which extends approximately the length of the work-engaging surface 22 along the length of the cylindrical portion 20.

Figure 3:
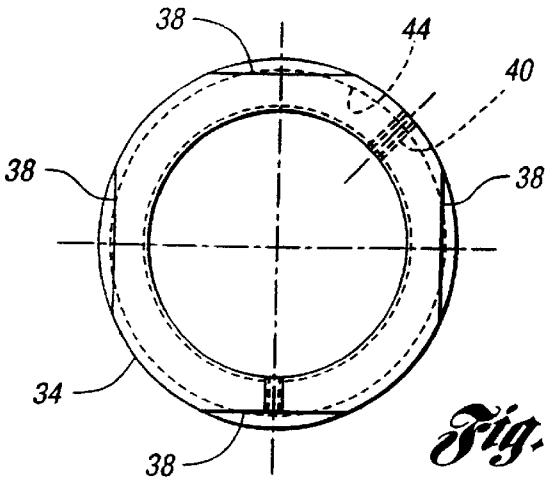
FIG. 3 shows an end view of the adjustment nut of FIG. 2.

An adjustment nut 34 is threadedly engaged with the substantially cylindrical portion 20 along the threads 36. Accordingly, the adjustment nut 34 is rotatably adjustable with respect to the substantially cylindrical portion 20 as a result of this threaded engagement 36. As shown in FIG. 3, the adjustment nut 34 also includes wrench flats 38 and a set screw hole 40 for receiving a set screw to secure the adjustment nut 34 in the desired position with respect to the substantially cylindrical portion 20 when adjusted.

Figure 2:
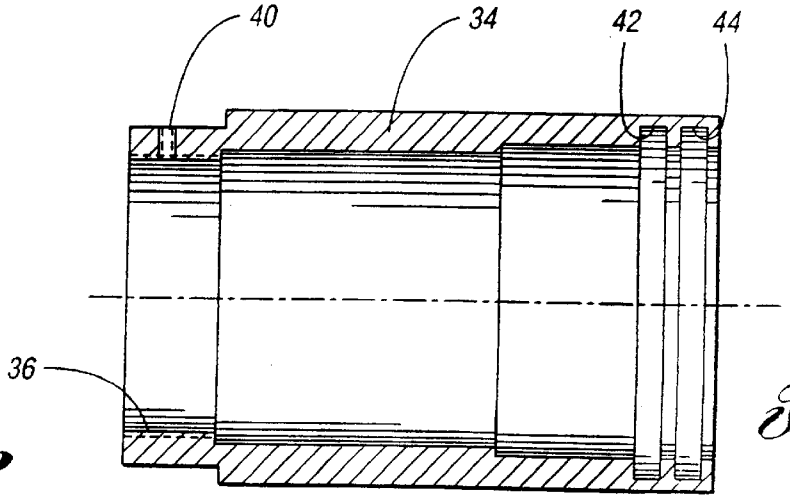
FIG. 2 shows a longitudinal cross-sectional view of an adjustment nut corresponding with the embodiment of FIG. 1.

As shown in FIG. 2, the adjustment nut 34 also includes grooves 42,44 for receiving the O-rings 46,48 (or any compressible or spring material), which are rubber preload rings operative to engage with the tapered outside surface 32 of the substantially cylindrical portion 20 to provide an adjustable compressive force on the substantially cylindrical member 20 to vary the diameter of the bore 26 for size adjustment of the O.D. surface 12 of the workpiece 14.

This embodiment is particularly applicable to superfinishing operations because the O-rings 46,48 are sufficiently compliant to allow very small adjustments.

By example, in order to reduce the size of the bore 26, the adjustment nut 34 is rotated with respect to the cylindrical portion 20, which causes the O-rings 46,48 to slide to the right (as viewed in FIG. 1) along the tapered outside surface 32, thereby compressing the O-rings 46,48 against the tapered outside surface 32, which provides a compressive force to reduce the width of the splits 28, thereby reducing the size of the bore 26 to ultimately reduce the O.D. of the workpiece 14 when the abrasive particles 26 are rotated against the O.D. surface 12.

Figure 6:
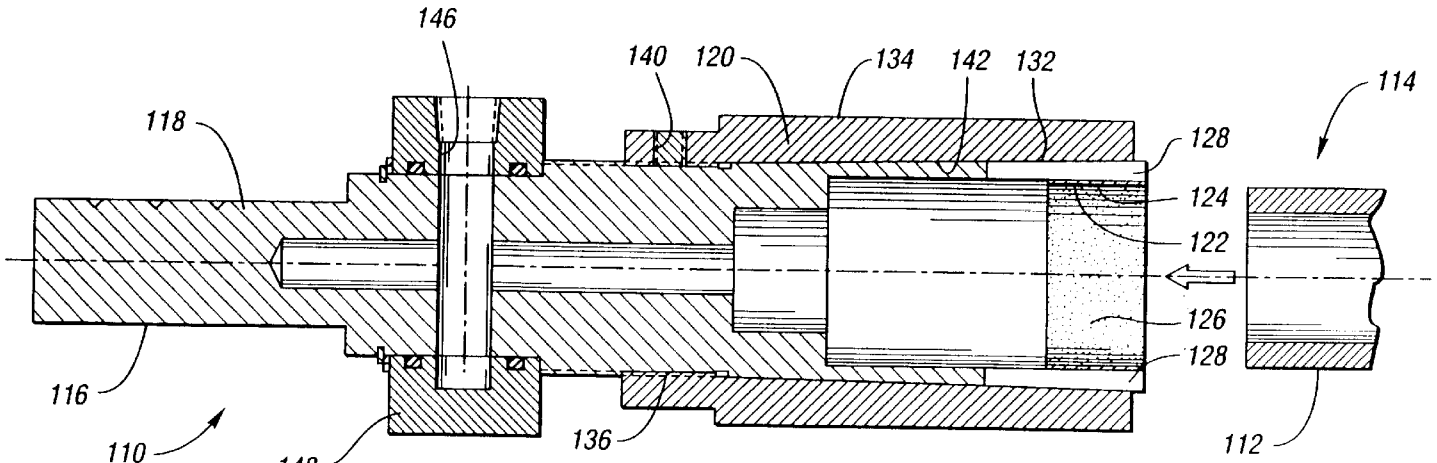
FIG. 6 shows a longitudinal cross-sectional view of a sizing tool and workpiece in accordance with an alternative embodiment of the invention.

An alternative embodiment of the invention is shown in FIG. 6. As shown, the O.D. sizer tool 110 is configured for sizing an O.D. surface 112 of a cylindrical workpiece 114. The O.D. sizer tool 110 includes a body 116 having a shank portion 118 and a substantially cylindrical portion 120. The substantially cylindrical portion 120 includes an inner work-engaging surface 122 having abrasive particles 124 thereon.

The inner work-engaging surface 122 forms a bore 126 to receive the workpiece 114. The substantially cylindrical portion 120 includes one or more longitudinally extending splits 128 to enable selective radial expansion and contraction of at least part of the cylindrical portion 120 for size adjustment of the bore 126 to size the O.D. surface 112 of the workpiece 114.

The substantially cylindrical member (portion) 120 includes a tapered outer surface 132.

An adjustment nut 134 is threadedly engaged with the substantially cylindrical portion 120 at the threaded portion 136. The adjustment nut 134 includes a set screw hole 140 for holding the adjustment nut 134 in a desired rotational position with respect to the substantially cylindrical portion 120.

The adjustment nut 134 also includes a tapered portion 142 which is slidably engaged with the tapered outer surface 132 of the substantially cylindrical portion 120 as the nut is rotated with respect to the substantially cylindrical portion 120 to expand or contract the inner work-engaging surface 122 for workpiece O.D. size adjustment.

Accordingly, as a result of the interference-type engagement between the tapered outer surface 132 of the substantially cylindrical portion 120 and the tapered portion 142 of the adjustment nut 134, relative sliding engagement of the surfaces 132,142 causes size adjustment of the inner work-engaging surface 122 as a result of the adjustable compressive forces applied to the substantially cylindrical member 120 by the tapered portion 142 of the adjustment nut 134. The embodiment shown in FIG. 6 is more rigid in structure than that shown in FIGS. 1–5, and is therefore more applicable to rougher cutting operations than the tool shown in FIGS. 1–5.

The tool 110 also includes a coolant aperture 146 formed in a sleeve 148 in communication with the bore 126 for carrying coolant to the bore 126 for cooling the workpiece 114. Alternatively, coolant may be delivered through the distal end (the left end as viewed in FIG. 6) of the shank portion 118.

The present invention recognizes that various other means may be provided for providing adjustable compressive forces on a substantially cylindrical portion of a tool for size adjustment of an internal bore thereof within the scope of the present invention. Once the means for adjusting the compressive force applied to the substantially cylindrical portion has been appropriately adjusted, the workpiece is inserted into the bore, and the tool is rotated with respect to the workpiece to size the O.D. surface.

In an alternative embodiment, the adjustment nut is not threaded to the cylindrical portion, but rather slides axially along the cylindrical portion. A handle may be provided for manually sliding the nut. This configuration enables quick disengagement of the O.D. sizing tool and eliminates the helical tool marks for applications such as seal surfaces.

These O.D. surface sizing tools are operative to "plateau" the surface of the workpiece to generate an Rpk value which is 3–10 times smaller than Rvk, thereby producing bearing ratios in excess of 40%, as these terms are described in commonly owned U.S. Pat. No. 6,139,414, which is hereby incorporated by reference in its entirety.

While the best modes for carrying out the invention have been described in detail, those familiar with the art to which this invention relates will recognize various alternative designs and embodiments for practicing the invention within the scope of the appended claims.

What is claimed is:

1. A tool for sizing an O.D. surface of a cylindrical workpiece, comprising:

a shank portion;

a substantially cylindrical portion extending from said shank portion and including a tapered outer surface and an inner work-engaging surface adapted for finishing the O.D. surface of the workpiece with abrasive particles, and said inner surface defining a bore to receive the workpiece and said substantially cylindrical portion further comprising at least one longitudinal split permitting radial expansion and contraction of at least part of the cylindrical portion; and an adjustment nut threaded onto the substantially cylindrical portion and including a tapered portion slidably engageable with said tapered outer surface as the nut is rotated with respect to the substantially cylindrical portion to expand or contract the inner work-engaging surface for workpiece O.D. size adjustment.

2. The tool of claim 1, wherein said inner work-engaging surface comprises abrasive particles plated thereon.

3. The tool of claim 1, further comprising a coolant aperture formed in communication with said bore for carrying coolant to the bore for cooling the workpiece.

4. The tool of claim 2, wherein said abrasive particles comprise diamond particles.

5. The tool of claim 1, wherein said adjustment nut includes wrench flats and a set screw.

6. A tool for sizing an O.D. surface of a cylindrical workpiece, comprising:

a rotatable substantially cylindrical member having an inner work-engaging surface adapted for finishing the O.D. surface of the cylindrical workpiece, said inner work-engaging surface including abrasive particles thereon and defining a bore to receive the workpiece, and said substantially cylindrical member including at least one longitudinal split permitting radial expansion and contraction of at least part of the cylindrical portion for workpiece O.D. size adjustment; and an adjustment nut threaded onto the substantially cylindrical member, and the adjustment nut and substantially cylindrical member include at least one tapered adjustment surface therebetween to facilitate said expansion and contraction of the bore as the adjustment nut is rotated with respect to the substantially cylindrical member.

7. The tool of claim 6, wherein said inner work-engaging surface includes a curved lead-in edge.

8. The tool of claim 6, wherein said tapered adjustment surface is formed on an outside surface of the substantially cylindrical member, and said adjustment nut includes at least one rubber preload ring engaged with the tapered adjustment surface to provide an adjustable compressive force on the substantially cylindrical member as the adjustment nut is rotated with respect to the substantially cylindrical member.

9. The tool of claim 6, wherein said substantially cylindrical member comprises a tapered outer surface and said adjustment nut comprises a tapered portion slidably engageable with said tapered outer surface as the nut is rotated with respect to the substantially cylindrical member to provide an adjustable compressive force on the substantially cylindrical member as a result of interference-type engagement between the tapered portion of the nut and the tapered outer surface of the substantially cylindrical member.

10. The tool of claim 9, wherein said inner work-engaging surface comprises abrasive particles plated thereon.

11. The tool of claim 6, further comprising a coolant aperture formed in communication with said bore for carrying coolant to the bore for cooling the workpiece.

12. The tool of claim 10, wherein said abrasive particles comprise diamond particles.

13. The tool of claim 6, wherein said adjustment nut includes wrench flats and a set screw.

14. A tool for sizing an O.D. surface of a cylindrical workpiece, comprising:

a shank portion;

a substantially cylindrical portion extending from said shank portion and having an inner work-engaging surface adapted for finishing the O.D. surface of the workpiece with abrasive particles, and said inner surface defining a bore to receive the workpiece, and said substantially cylindrical portion further comprising at least one longitudinal split permitting radial expansion and contraction of at least part of the cylindrical member; and means for adjustably compressing the substantially cylindrical member including a tapered outer surface on the substantially cylindrical member to adjust the inner work-engaging surface bore.

15. The tool of claim 14, wherein said means for adjustably compressing comprises a tapered portion of an adjustment nut which is threaded onto the substantially cylindrical portion and which engages the tapered outer surface on the substantially cylindrical portion in a manner to adjust compressive forces by rotating the adjustment nut with respect to the substantially cylindrical member to adjust an interference fit between the tapered portion of the substantially cylindrical member and the tapered outer surface of the nut.

16. The tool of claim 14, wherein said means for adjustably compressing comprises an adjustment nut threaded onto the substantially cylindrical portion, wherein said adjustment nut and substantially cylindrical member include at least one tapered adjustment surface therebetween to facilitate said expansion and contraction as the adjustment nut is rotated.

17. The tool of claim 16, wherein said tapered adjustment surface is formed on an outside surface of the substantially cylindrical member and said adjustment nut includes at least one rubber preload ring engaged with the tapered adjustment surface to provide an adjustable compressive force on the substantially cylindrical member as the adjustment nut is rotated with respect to the substantially cylindrical member.

* * * * *